United States Patent [19]

Kitajima et al.

[11] 4,442,190

[45] Apr. 10, 1984

[54] METHOD AND APPARATUS FOR IMAGE FORMATION UTILIZING A BLOCKING MEMBER FOR BLOCKING AN ION FLOW THROUGH A PHOTOSENSITIVE SCREEN TO PROVIDE A NON-IMAGE AREA

[75] Inventors: Tadayuki Kitajima; Nobuhiro Kasama, both of Yokohama, Japan

[73] Assignee: Canon Kabushiki Kaisha, Tokyo, Japan

[21] Appl. No.: 285,669

[22] Filed: Jul. 21, 1981

Related U.S. Application Data

[63] Continuation of Ser. No. 97,863, Nov. 27, 1979, abandoned.

[30] Foreign Application Priority Data

Dec. 8, 1978 [JP] Japan ..... 53-151765

[51] Int. Cl.[3] ..... G03G 13/02

[52] U.S. Cl. ..... 430/53; 355/3 SC

[58] Field of Search ..... 430/53, 68, 902; 355/3 SC, 3 CH

[56] References Cited

U.S. PATENT DOCUMENTS

| | | | |
|---|---|---|---|
| 3,594,162 | 7/1971 | Simm et al. | 430/902 |
| 3,942,080 | 3/1976 | Milewski | 430/902 |
| 4,105,444 | 8/1978 | Shinohara et al. | 430/31 |
| 4,141,644 | 2/1979 | Sato et al. | 355/3 CH |
| 4,174,170 | 11/1979 | Yamamoto et al. | 355/3 CH |

*Primary Examiner*—John E. Kittle

*Assistant Examiner*—John L. Goodrow

*Attorney, Agent, or Firm*—Fitzpatrick, Cella, Harper & Scinto

[57] ABSTRACT

An image forming technique employing a screen photosensitive medium having therein a plurality of fine openings. Using such screen photosensitive medium an electrostatic latent image is formed on an electric charge retainable member to be modulated under the action of a modulated corona ion stream. A non-image area can be formed on the member to be modulated by providing an ion stream blocking member between a modulation ion source and the screen photosensitive medium to block the ion stream flowing from the ion source to the screen photosensitive medium at a desired and limited area. The present invention enables to form a very sharp boundary between image area and non-image area.

11 Claims, 6 Drawing Figures

METHOD AND APPARATUS FOR IMAGE FORMATION UTILIZING A BLOCKING MEMBER FOR BLOCKING AN ION FLOW THROUGH A PHOTOSENSITIVE SCREEN TO PROVIDE A NON-IMAGE AREA

This is a continuation of application Ser. No. 97,863, filed Nov. 27, 1979 now abandoned.

BACKGROUND OF THE INVENTION

1. Field of the Invention

The present invention generally relates to a method and apparatus for forming an image using a photosensitive medium in the form of a screen having therein a plurality of fine openings which is hereinafter referred to also merely as a screen.

More particularly, the present invention is directed to a novel means for producing a non-image area on the modulated member at the time of modulation in the image forming process using the above-mentioned screen.

2. Description of the Prior Art

The screen used in the invention is, for example, a multilayer structure composed of photo-conductive material and electrically conductive material and, optionally, insulating material having a plurality of fine openings formed therein. Various processes of forming an image by using such a screen have been known in the art. An example of the image forming process is of the type in which a primary electrostatic latent image is formed on the screen by initially charging the screen with electric charge using a corona discharger or the like and then projecting a light image of an original on the screen, and a secondary electrostatic latent image is formed on an electrifiable member by an ion stream controlled under the action of an electric field formed on the screen openings in accordance with the primary electrostatic latent image on the screen. This type of image forming technique is disclosed in U.S. Pat. No. 3,645,614 and generally called ion stream control type of electrophotographic method. The secondary electrostatic latent image formed on the electrifiable member in the above described manner can be developed and fixed using a conventional developing device and fixing device.

One of the important problems involved in the image forming apparatus using such screen photosensitive medium is the scattering of toner. Scattered toner often blocks the openings of the screen which is usually in the order of several hundreds mesh. If blocking occurs, the modulation ability of the screen is substantially reduced or the screen is damaged by the phenomenon of leakage occurring when a bias voltage is applied. The trouble caused by toner scattered within the main body of the apparatus may be prevented to some extent by providing means for preventing scattering of toner at some toner treating stations such as the developing station and cleaning station. However, even when such prevention means is employed, it is impossible to effectively prevent toner from being scattered on a copy sheet which has not been developed yet. This problem will be more concretely described hereinafter with reference to a copying machine of the type in which a latent image is formed on a dielectric drum by imagewise modulating an ion stream with the aid of the above described screen, wherein the latent image is developed with toner, the toner image is then transferred onto a sheet member such as transfer paper and the transferred toner image is fixed on the sheet by heat roller fixing means.

As is well known to those skilled in the art, in the above mentioned copying machine there are some steps at which a wind rises. At the transfer station, a wind toward the front side of the sheet rises when the fore end of the sheet is electrostatically drawn to the surface of the drum. Also, after transferring a wind rises at the front part of the sheet when the latter is stripped from the drum surface. Such wind disperses the toner on the fore end of the sheet and makes the fore edge of the sheet dirty. Furthermore, at the time of the dirty sheet being conveyed through the apparatus, the sheet is subjected to vibration which causes a scattering of the toner from the fore edge portion of the sheet. It is a matter of course that the quality of the copy is substantially reduced by such dirt toner on the fore end part of the sheet. In the worst case, at the fixing station using heat roller fixing means, the sheet may be caught into the fixing roller due to the toner adhered onto the fore edge of the sheet.

To separate a sheet from the dielectric drum, belt or pawl is widely used. But, such sheet separation means also constitutes a source of generation of scattered toner. When such sheet separation means comes into contact with the toner on the drum surface, the toner is sometimes scattered.

The most effective solution to the above mentioned problem of toner scattering is that no image be formed at the problematical portions such as the fore end part of the image area on the dielectric drum and the side edge portions thereof at which sheet separation means works. In other words, the solution is to intentionally form a non-image portion within the area where an image can otherwise be formed. Some methods to realize the solution have been proposed and already used.

A representative of the known method comprises irradiating light on a limited area of the screen which corresponds to the area at which it is desired to form a non-image area. Conventionally, this method is carried out by projecting a lamp light directly on the subject area of the screen. However, it is impossible to form satisfactorily sharp boundaries employing this method because of diffusion of the irradiated light. It is true that this method is somewhat effective in forming a sharp boundary at the side part of the image area. But, it is practically impossible to exclusively irradiate light at only the fore end and/or the rear end of the image area. Therefore, a sufficiently sharp boundary can scarcely be formed at the fore- and rear end parts by this method. Another disadvantage of this known lamp method is found in the increase of electric power consumption caused by the additional lamp required for forming a non-image area. Taking into consideration the fact that the photosensitive medium used therein is in the form of a screen having a plurality of fine openings and that light is diffused on the screen, such irradiation of light to the screen is undesirable, apart from other problems involved in the known method.

Another method proposed to form a non-image area without irradiation of light on the screen is that in the developing device there is provided a limiting member for limiting the area to be developed by the developing device. However, this method is not versatile. It is difficult to form a non-image area exclusively at the fore edge portion of the image area or to exchange the non-image area to be formed from one to another at the user's will.

SUMMARY OF THE INVENTION

Accordingly, it is a general object of the present invention to enable, in accordance with the image forming technique using a screen, to form any desired non-image area on a member to be modulated in a very simple and reliable manner.

According to the invention the above object is attained by providing, between an ion stream source for modulation and a screen photosensitive medium, an ion stream blocking member for preventing the ion stream flowing from the ion source from reaching the screen photosensitive member so as to produce a non-image area on the modulated member at the time of modulation.

The term "a member to be modulated" used herein should be understood to mean, for example, a sheet or drum member having thereon an electric charge retaining surface on which a latent image (secondary latent image) can be formed. The latent image formed on the modulated member is later visualized by developing agent such as toner and the visualized image is brought to use directly or through a transferring step.

The term "non-image area" used herein should be understood to include:

(i) fore end part of an image area;

(ii) one or both side parts of an image area;

(iii) surrounding area enclosing the entire image area; and (iv) any portion of an image area. These non-image areas are sometimes contained inside the actual area of a sheet member and sometimes outside of it. For example, there is the case in which although a non-image area is present on the dielectric drum, the non-image area does not appear on a transfer sheet on which the toner image has been transferred. The term "non-image area" also includes such case.

The above non-image area (i) primarily prevents the toner from being scattered and prevents the sheet material from being caught into the fixing roller. The effect attainable by (ii) is to prevent the toner from being scattered by the sheet separation belt and to prevent the belt from being soiled with toner, which in turn prevents the end portions of sheet members from being darkened. The non-image area (iii) has an effect in improving the image quality in addition to the same effects as attained by (i) and (ii). According to (iv), it is possible to make an overlaid image by combining a first image with a second image.

The present invention makes it possible to form a non-image area in forming an image forming apparatus using a screen photosensitive medium. The image forming apparatus according to the invention includes no complicated additional means for forming the desired non-image area. An image area can be formed in a very simple and reliable manner in accordance with the invention. The problem of scattering toner can be prevented effectively and therefore the quality of image is improved according to the invention.

Other and further objects, features and advantages of the invention will appear more fully from the following description taken in connection with the accompanying drawings.

DESCRIPTION OF THE PREFERRED EMBODIMENTS

Figure 1:
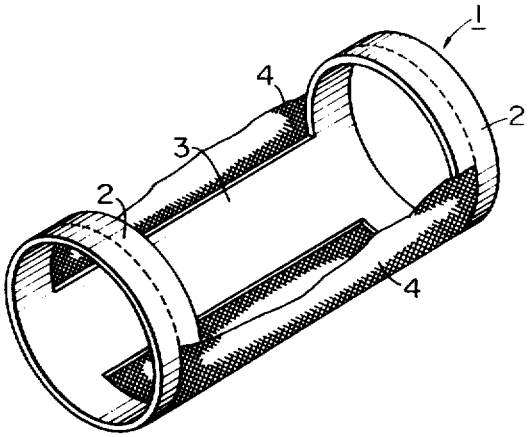
FIG. 1 is a perspective view of a frame member with a screen mounted thereon.

Now, referring to the accompanying drawings the present invention is described in detail. While the present invention is applicable to various types of image forming apparatus, for the sake of illustration there is shown in the drawings such type of image forming apparatus in which a primary latent image is formed on a drum-shaped screen and then a secondary latent image is formed on a dielectric drum following the primary latent image.

FIG. 1 illustrates a drum-shaped screen which is simple in structure and easy to make. The drum-shaped screen comprises a frame member generally designated by 1 and a screen 4 supported on the frame member. The frame member 1 is composed of two end ring portions 2 and a connecting web portion 3 connecting the two end ring portions. The frame member 1 defines the outline of a drum. The screen 4 is mounted on the frame member along the outline of the drum so as to complete the drum as shown in FIG. 1. The free edges of the screen 4 are suitably secured to the frame member, for example, by a bonding agent. Since the frame member 1 is very simple in structure, a drum-shaped screen can be formed in an inexpensive and convenient manner. In FIG. 1 the frame member 1 is shown to have two ring portions 2, 2 integrally formed with the connecting web portion 3. But, it is not always necessary to form the frame member as a one-piece member. The web portion 3 and two end ring portions 2, 2 may be made initially as separate members which can be assembled together into the frame member later by means of screws or a bonding agent.

Figure 2:
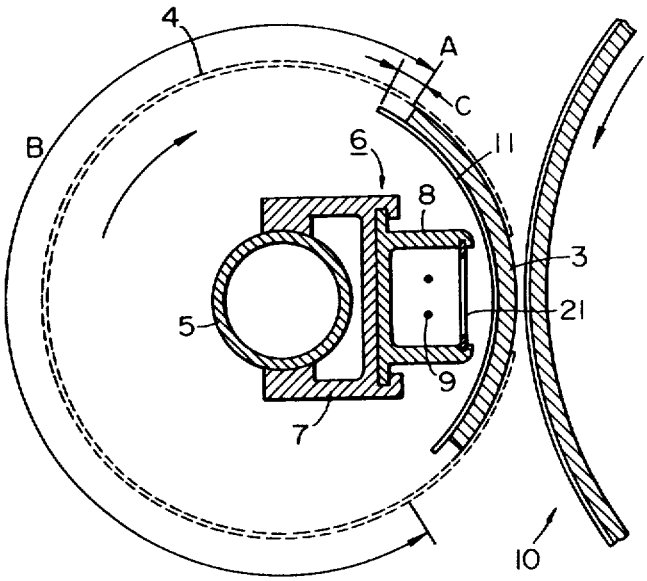
FIG. 2 is a cross-sectional view of a modulation part.

FIG. 2 shows, in a cross sectional view, a modulation part of the image forming apparatus and illustrates the manner of embodying the present invention in the drum-shaped screen shown in FIG. 1. In FIG. 2, the reference numeral 5 designates a rotation shaft of the screen frame 1. 6 is a modulation corona discharger which is removably mounted on a rail 7. The rail 7 is secured on the rotation shaft 5. For mounting, the corona discharger 6 can be introduced into the screen frame 1 by moving the discharger inward in the axial direction along the rail 7. The discharger 6, when desired, can be removed from the screen frame by moving the discharger in the opposite direction along the rail. Designated by 8 is a shield plate which serves also as a guide for the discharger 6. The reference numeral 9 designates a wire for corona discharge. Opposed to the screen frame 1 is a dielectric drum 10 which has, on its top surface, a dielectric layer for retaining the stream of modulated corona ion.

While not shown in the drawing, there is provided mean for forming a primary latent image. Said primary latent image forming means is disposed around the circumference of the drum-shaped screen in the manner known per se and is rotated in the direction indicated by the arrow to effect formation of a primary latent image and modulation. Also, the dielectric drum 10 is driven into rotation at a speed corresponding to the peripheral speed of the screen frame in the direction of the arrow.

The above said primary latent image forming means including optical means is operated in such a manner that a primary latent image can be formed on a surface of the screen 4 covering the area B starting from the screen edge A.

In the conventional apparatus with the same arrangement as described above, the secondary latent image formed on the surface of the dielectric drum 10 through the action of the corona discharger 6 completely corresponds to the primary latent image formed on the area B and therefore covers the entire area of the primary one. Contrary to the standards of the prior art, the image area of the secondary latent image formed on the dielectric drum according to the shown embodiment of the invention does not correspond to that of the primary latent image formed on the screen area B. A portion of the primary latent image extends from the screen edge A some distance, that is, the area C is cut away from the area B in the second latent image. This constitutes a particular feature of the present invention. Attention should be directed to a member designated by 11 in FIG. 2.

The member 11 is made of a film or sheet of insulator or resistor having lower resistance than the insulator. The function of the member 11 is to block the ion stream flowing to the screen from the corona discharger. In the shown embodiment, the blocking member 11 is fixed to the inside of the connecting web portion 3 of the above described screen frame member 1 and extends beyond the edge A so as to cover the area C. In operation, the blocking member 11 prevents the modulated ion stream from reaching the area C of the screen 4. As a result, the area C is cut away from the image area B and it appears as a non-image area on the secondary latent image on the dielectric drum 10. The area C corresponds to the fore edge portion of an image area.

In this manner, according to the present invention, a non-image portion can be formed very simply at the fore edge portion of an image area. Neither shutter means for the lamp nor switching means for putting the lamp on and off is required to form the non-image portion. Means for forming the non-image portion according to the invention is very simple in structure and involves no problem of noise generation.

The blocking member 11 which may be, for example, a film of polyethylene terephthalate can be bonded directly to the connecting web portion of the screen frame 1. Alternatively, the blocking member 11 may be removably mounted on it in a suitable manner, for example, as shown in connection with the corona discharger 6. In the latter case, the non-image portion can be changed as desired. Also, the blocking member 11 may be disposed at the rear edge portion of an image area.

Figure 3:
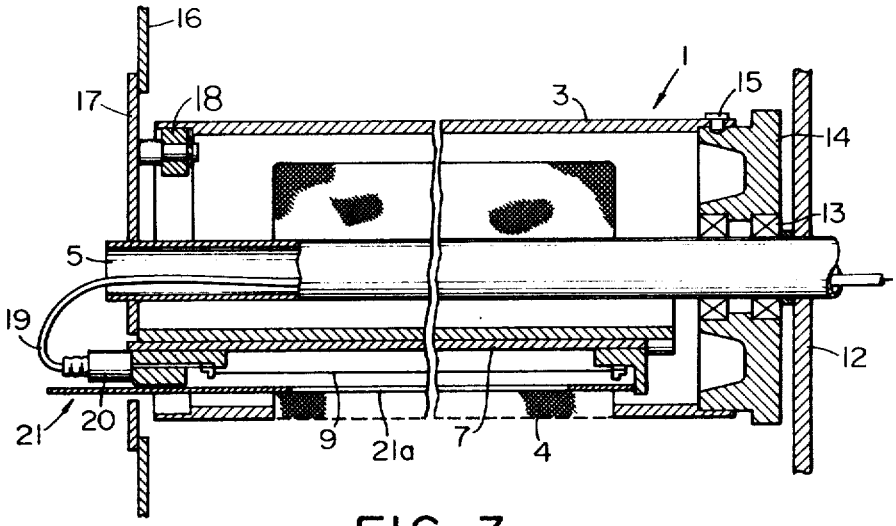
FIG. 3 is a longitudinal sectional view of a modulation part.

FIG. 3 illustrates an arrangement of modulation parts useful for forming a non-image portion at the side edge of an image area in accordance with the present invention.

In this embodiment, the supporting shaft 5 for the screen frame 1 is stationary and one end of the shaft is fixedly supported by the rear wall plate 12 of the main body of the apparatus. The screen frame is driven by a gear 14 mounted on the shaft through a ball bearing 13. At the shoulder of the gear 14, the screen frame 1 is connected with the gear by a pin 15 so that the screen frame may be rotated together with the gear 14. The other end of the supporting shaft 5 is fitted into a centering plate 17 to hold the shaft at its position. The centering plate 16 serves also as a cover plate closing the opening of the front wall plate 16 of the main body of the apparatus. To rotatably support the end of the drum-shaped screen at this front side, there are provided rollers 18 distributed along the inner circumference of the screen drum.

The corona discharger 6 can be introduced into and removed from the apparatus passing through an opening of the centering plate 17. A high voltage is supplied to the corona discharger 6 through a high voltage cable 19 and a connector 20.

In a manner similar to that shown in FIG. 2, a shield plate for the modulation corona discharger 6 has a guide slot along which a blocking member can be inserted into the apparatus. The blocking member is in a form of an elongated masking plate made of electrically insulating material as seen in FIGS. 4 and 5.

Figure 4:
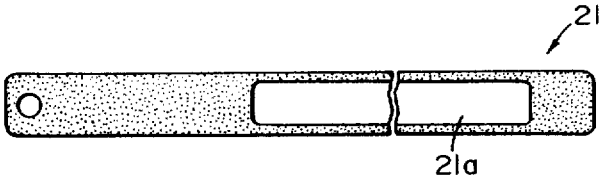
FIGS. 4 and 5 show two examples of an ion stream blocking member.
Figure 5:
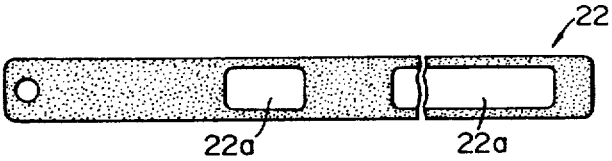

The blocking member 21 shown in FIG. 4 has an opening 21*a* and the blocking member 22 shown in FIG. 5 has two openings 22*a*, 22*a* which are different in size and shape from each other. This blocking member blocks a corona ion stream while allowing the ion stream to pass through only the opening area. The number and shape of the openings provided in one blocking member may be changed variously as desired by the user of the apparatus. Therefore, if a set of such blocking members having different openings is prepared as an accessory unit for the apparatus, then the copy making operator can select any one of the blocking plates to form a non-image portion at a selected area most suitable for his purpose. Material preferably used for the blocking member is, for example, insulating synthetic resin.

Figure 6:
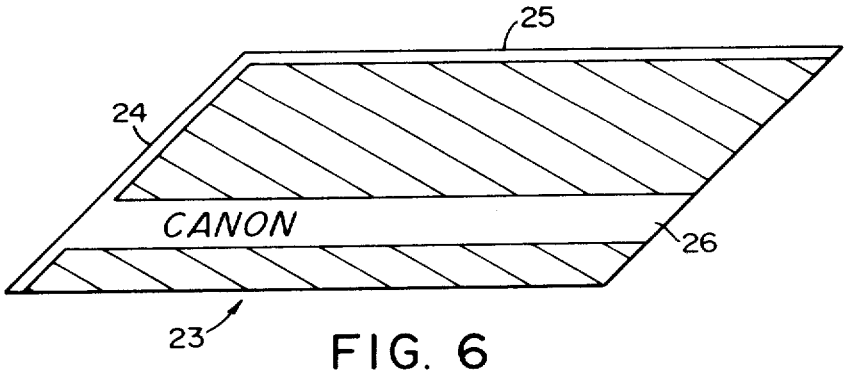
FIG. 6 is a perspective view of a sheet having thereon image area and non-image area.

An example of a copy made using the above described blocking members is shown in FIG. 6. Designated by 23 is a copy sheet having thereon a copied image. 24 is a non-image portion formed at the fore edge and 25 is that formed at the side edge. The portion designated by 26 is a non-image portion formed in the image forming area by employing a masking blocking member as shown in FIG. 5. All the area other than these non-image portions constitute an image area on which a copied image can be formed. The non-image portion at the side edge 25 was formed taking into consideration the fact that a sheet separation means was provided at this side. If desired, a continuous non-image portion enclosing all the image area may be formed to improve the image quality. The non-image portion 26 extends stripwise in the moving direction of the copy sheet during copying operation. This non-image portion 26 can be advantageously used to previously print some desired information on the copy sheet. For example, company name, note, remark and the like may be printed previously as illustrated by "CANON" in FIG. 6.

As will be understood from the foregoing, the provision of a blocking member against an ion stream between the ion source and the screen according to the present invention enables formation of a desired non-image portion in a satisfactory state. But, to obtain the full effect of the present invention, particular consideration must be given to the mounting position at which the blocking member is to be mounted.

In the case of the blocking member 21, it is preferably mounted on the shield plate for the corona discharger as described above. Alternatively, it may be mounted at the marginal area of the image portion of the screen frame 1 just as in the case of the blocking member 11. Many may consider that an insulating film might be bonded directly on the screen 4 to attain the same effect as above. But this should be avoided, particularly when a drum-shaped screen is used in the apparatus. By directly attaching such blocking film on the screen, the strength of the screen may be varied portion by portion which will result in deformation of the screen.

It is not advisable to mount an insulating blocking member at the opposite side to the screen 4 relative to the corona discharger 6. This is because the electric field along the border line between image area and non-image area is often bent and thereby a distortion of secondary latent image which has a close relation with the quality of the final image is caused when the blocking member is overcharged with the ion stream imagewise modulated by the screen.

Also, mounting an electrically conductive blocking member at the outer side should be avoided. If mounted so, a spark discharge may be caused when a high bias voltage is applied to the screen and the member to be modulated during the time of modulation. Such spark discharge often damages the screen itself and also other members near the screen.

While the invention has been particularly shown and described with reference to preferred embodiments thereof, it will be understood by those skilled in the art that the foregoing and other changes in form and details can be made therein without departing from the spirit and scope of the invention.

What we claim is:

1. A method of forming an image by imagewise modulation of an ion stream, making use of an electric field formed on a photosensitive medium in a form of a screen mounted on an outer periphery of a drum-shaped frame, which is characterized by placing said screen photosensitive medium and an ion stream source in a spaced relation, wherein said source is located inside said drum-shaped frame, and by disposing a blocking member comprising an insulator or resistor material between said source and an inner periphery of said drum-shaped frame for preventing the ion stream from reaching a portion of said screen along a periphery of said frame, so as to form a non-image area on an image receiving member to which the ion stream is applied at the time of modulation.

2. An image forming method according to claim 1 which is characterized in that said image receiving member is a movable member which is transported in a direction so as to form a non-image area at the leading end portion of the image receiving member.

3. An image forming method according to claim 1 which is characterized in that said ion stream blocking member is disposed between said inner periphery of said drum-shaped frame and said ion stream source so as to form a non-image area at a side portion of an image formed on the image receiving member.

4. An image forming method according to claim 1 which is characterized in that said ion stream blocking member is disposed between said inner periphery of said drum-shaped frame and said ion stream source so as to form a non-image area at a marginal portion of an image formed on the image receiving member.

5. An image forming method according to claim 1 which is characterized in that said ion stream blocking member is disposed between said inner periphery of said drum-shaped frame and said ion stream source so as to form a non-image area at a portion within an image formed on the image receiving member.

6. An image forming apparatus of the type in which an image is produced by imagewise modulation of an ion stream, making use of an electric field formed on a photosensitive medium in a form of a screen, mounted on an outer periphery of a drum-shaped frame, said apparatus comprising a corona discharger for effecting modulation, a screen-type drum-shaped photosensitive medium, and a blocking member comprising an insulator or resistor material which is separate from the frame and which is disposed between an inner periphery of said drum-shaped frame and said discharger for preventing the ion stream from reaching a portion of said screen along a periphery of said frame, so as to produce a non-image area on an image receiving member to which the ion stream is applied at the time of modulation.

7. An image forming apparatus according to claim 6 which is characterized in that said frame is rotatable and has a transverse portion defining leading and trailing edges of said screen mounted thereon, and said ion stream blocking member is disposed adjacent said leading edge of said drum-shaped screen.

8. An image forming apparatus according to claim 6 which is characterized in that said ion stream blocking member is disposed adjacent a longitudinal end portion of said modulation corona discharger.

9. An image forming apparatus according to claim 6 which is characterized in that said ion stream blocking member is disposed at a side part of the frame on which said drum-shaped screen photosensitive medium is mounted.

10. An image forming apparatus according to claim 9 which is characterized in that said image receiving member is a movable member transported so as to form non-image areas at leading and trailing edges of said image receiving member.

11. An image forming apparatus according to claim 6 which is characterized in that said ion stream blocking member is mounted in alignment with a portion of the discharge area of said modulation corona discharger.

* * * * *